US008408791B1

(12) United States Patent
Wang

(10) Patent No.: US 8,408,791 B1
(45) Date of Patent: Apr. 2, 2013

(54) STORAGE BAG

(76) Inventor: Wen-Tsan Wang, Taipei (TW)

( * ) Notice: Subject to any disclaimer, the term of this patent is extended or adjusted under 35 U.S.C. 154(b) by 67 days.

(21) Appl. No.: 13/249,254

(22) Filed: Sep. 30, 2011

(51) Int. Cl.

| | |
|---|---|
| ***B65D 33/16*** | (2006.01) |
| ***B65D 33/10*** | (2006.01) |
| ***B65D 33/06*** | (2006.01) |
| ***B65D 30/16*** | (2006.01) |
| ***B65D 30/14*** | (2006.01) |

(52) U.S. Cl. ..... 383/99; 383/10; 383/15; 383/104; 383/119

(58) Field of Classification Search ..... 383/10, 383/98, 99, 104, 119, 12, 15, 29, 14
See application file for complete search history.

(56) References Cited

U.S. PATENT DOCUMENTS

| | | | | |
|---|---|---|---|---|
| 1,726,740 | A * | 9/1929 | Joffe | 383/9 |
| 1,826,976 | A * | 10/1931 | Wright | 190/117 |
| 1,846,542 | A * | 2/1932 | Budd | 383/15 |
| 1,907,172 | A * | 5/1933 | Arzet | 383/119 |
| 3,502,258 | A * | 3/1970 | Kugler et al. | 383/6 |
| 3,568,918 | A * | 3/1971 | Blomqvist | 383/109 |
| 4,248,364 | A * | 2/1981 | Anderson | 383/6 |
| D444,948 | S * | 7/2001 | Buchanan et al. | D3/303 |
| 2011/0081102 | A1 * | 4/2011 | Wang | 383/10 |

FOREIGN PATENT DOCUMENTS

FR 2559128 A1 * 8/1985

* cited by examiner

*Primary Examiner* — Jes F Pascua
(74) *Attorney, Agent, or Firm* — Leong C. Lei

(57) ABSTRACT

An improved storage bag comprises a bag body that defines an opening at a top thereof and two folding lines respectively at two opposing sides thereof. The bag body is provided with two handles respectively at the two opposing sides above the folding lines, so that when the bag body is extended into shape, the handles can be folded relative to the bag body along the folding lines to be overlapped horizontally. The bag body is provided with at least one support bar at each of the two opposing sides. Each support bar extends from a bottom of the bag body to an underside of one of the handles. The support bars can engage with the underside of one of the handles to support the bag body in the extended shape, thereby preventing the bag body from a collapse when the storage bag is in use.

3 Claims, 7 Drawing Sheets

STORAGE BAG

TECHNICAL FIELD OF THE INVENTION

The present invention relates to an improved storage bag that can be used for collecting articles or recycling items.

DESCRIPTION OF THE PRIOR ART

The structure of a conventional bag is generally provided with two handles respectively at two sides thereof. A user may put articles in the bag and then carry the bag away by its handles. The function of the conventional bag is limited only for carrying articles.

In modern society, environmental protection is emphasized and the citizens have a consensus that the recycling of resources should be well conducted. To achieve the purpose of environmental protection, recycling bins are placed in public places according to the categories of the items to be recycled, in which words and/or images would be specified on each bin. As to families, due to the limited space of a house, the recycling bins are unsuitable to them. Thus, there is a need to provide a container with simple structure and portable feature, which can be used for collecting recycling items conveniently.

There is a U.S. Patent Application, with application Ser. No. 12/574,714, is disclosed to solve the foregoing problem. The primary feature of the disclosure is that the bag is provided with two magnetic rings respectively at two cover flaps so that the two cover flaps can attract each other when the bag is stretched into shape. The two magnetic rings are each provided around a handle hole, so that articles can be put in the bag through the handle holes. When the bag is full of articles, the cover flaps can be restored to their original positions and the bag can be carried away for a recycling treatment. However, there is a drawback existed in the disclosed bag. The drawback is that the bag body of the disclosure lacks sufficient strength to support the bag in the stretched shape and thus a collapse of the bag body would occur. Thus, there is a need for improvement.

SUMMARY OF THE INVENTION

The primary object of the present invention is to provide a storage bag for solving the drawback of the disclosed U.S. patent application Ser. No. 12/574,714, whereby the bag body can be further strengthened to prevent it from a collapse when it is extended into shape.

According to one feature of the present invention, the storage bag is based on the disclosed U.S. patent application Ser. No. 12/574,714 to further provide two support bars at two opposing sides of the bag body, so that when the handles are overlapped horizontally to close the opening of the bag body, the two support bars can engage with the underside of one of the handles to prevent the bag body from a collapse and increase the strength of the bag body.

The storage bag comprises a bag body that defines an opening at a top thereof and two folding lines respectively at two opposing sides thereof. The bag body is provided with two handles respectively at the two opposing sides above the folding lines, so that when the bag body is extended into shape, the handles can be folded relative to the bag body along the folding lines to be overlapped horizontally. The bag body is provided with at least one support bar at a middle section of each of the two opposing sides below the handles. Each support bar extends from a bottom of the bag body to an underside of one of the handles. Each support bar has a length less than the distance from the bottom of the bag body to one of the folding lines, so that the support bars can engage with the underside of one of the handles to support the bag body in the extended shape and increase the strength of the bag body when the handles are overlapped horizontally to close the opening of the bag body.

According to another feature of the present invention, the two support bars are respectively affixed to two opposing inner surfaces of the bag body below the two handles.

According to a further feature of the present invention, the two handles are respectively provided with fastening members that can be detachably fastened with each other, so that the two handles can be combined together by coupling the fastening members when the two handles are overlapped to close the opening of the bag body.

According to a still further feature of the present invention, the fastening members respectively provided on the two handles can be magnets, Velcro fasteners, or buttons.

According to a still further feature of the present invention, the bag body can be designed in various shapes according to the preferences of users.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
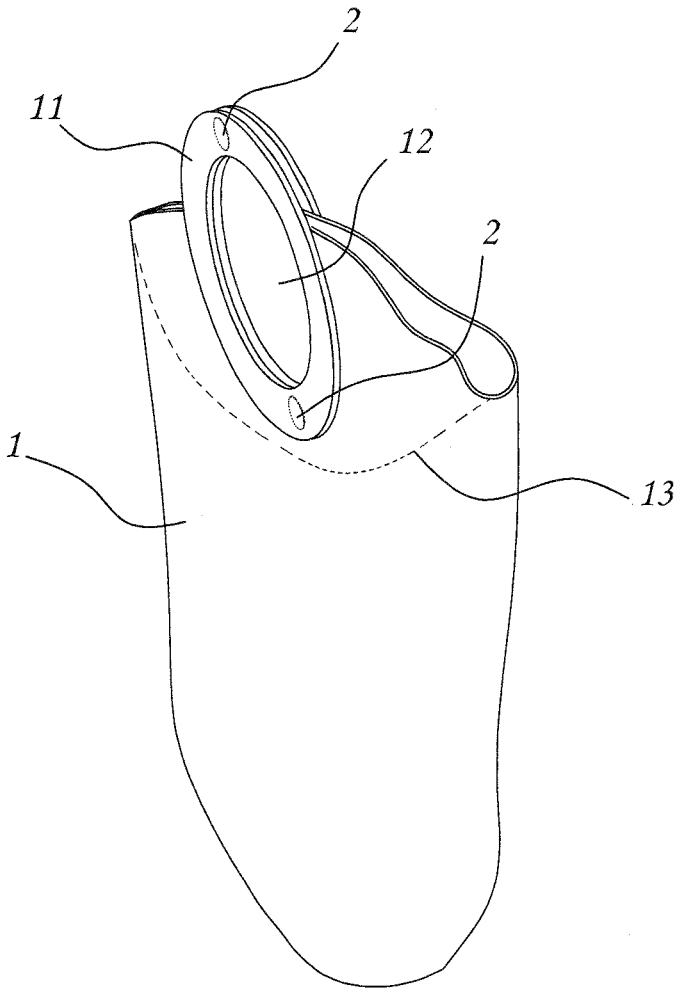
FIG. 1 is a 3-dimesnional view of a storage bag according to one embodiment of the present invention, which shows a collapsed condition of the bag.
Figure 2:
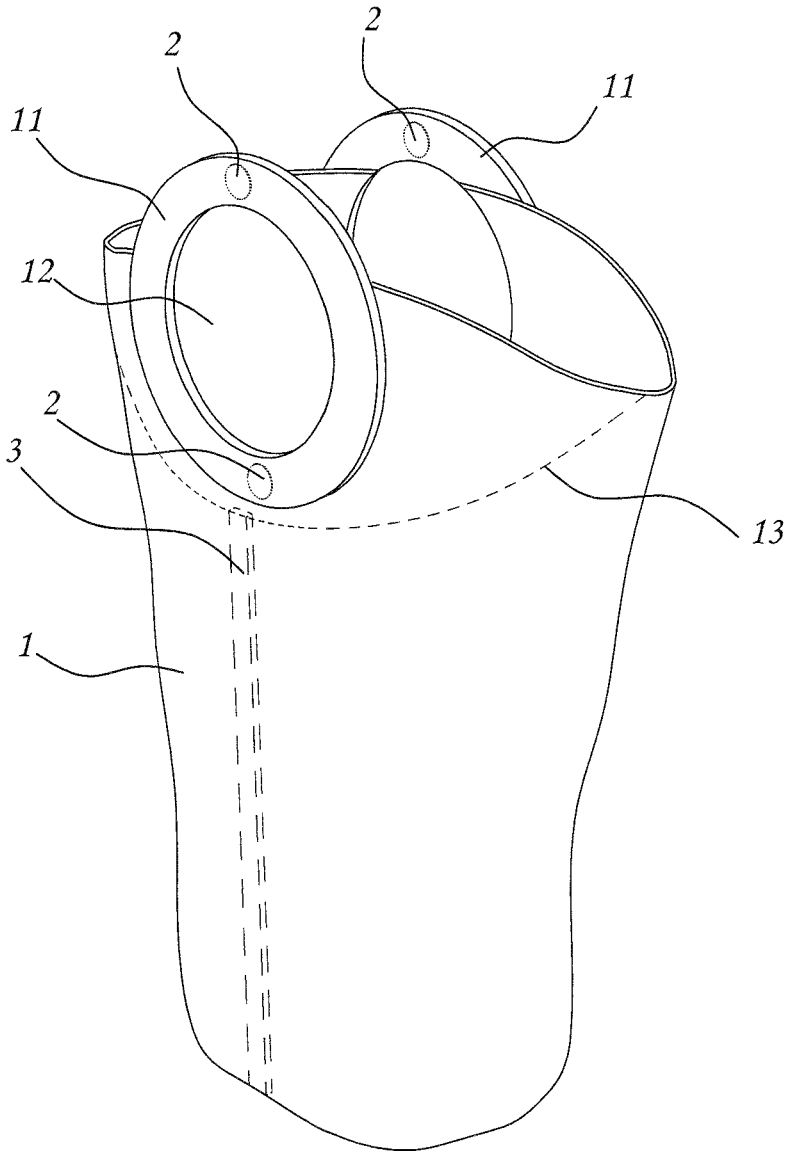
FIG. 2 is a 3-dimensional view of the storage bag, in which two handles of the bag are separated from each other.
Figure 3:
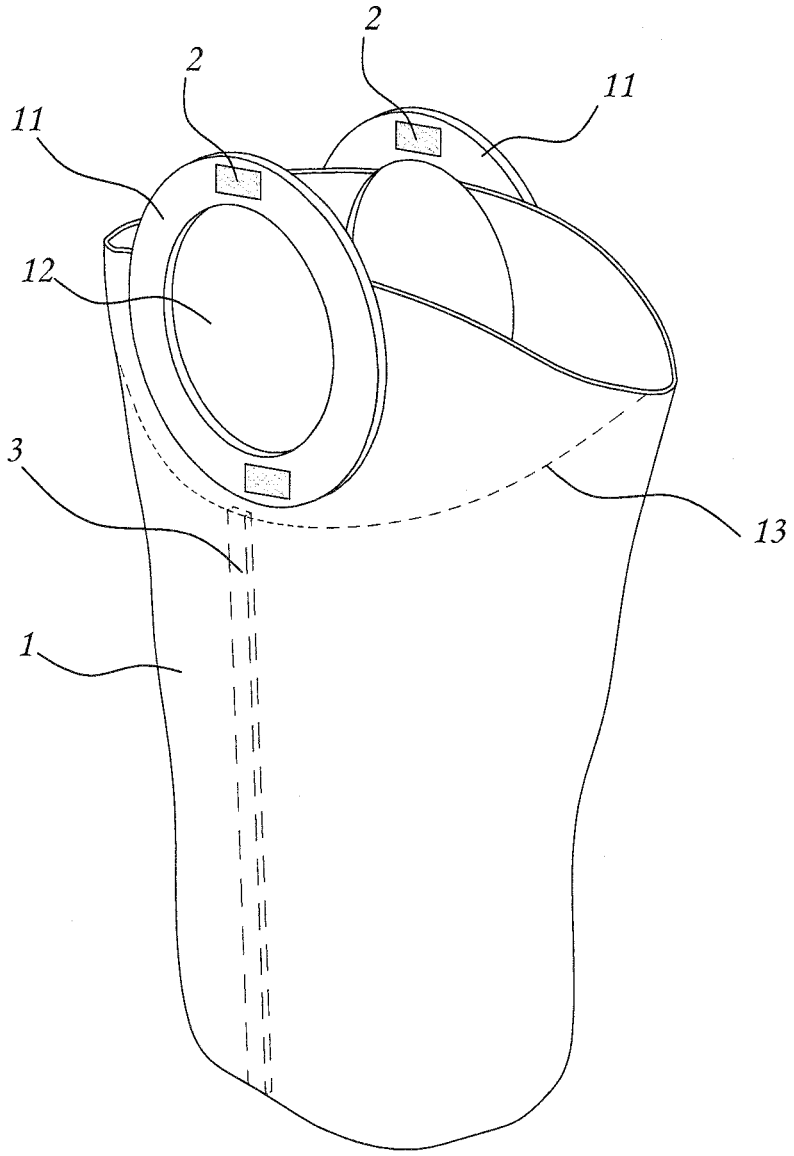
FIG. 3 is a 3-diemsional view of the storage bag, in which the two handles are provided with fastening members
Figure 4:
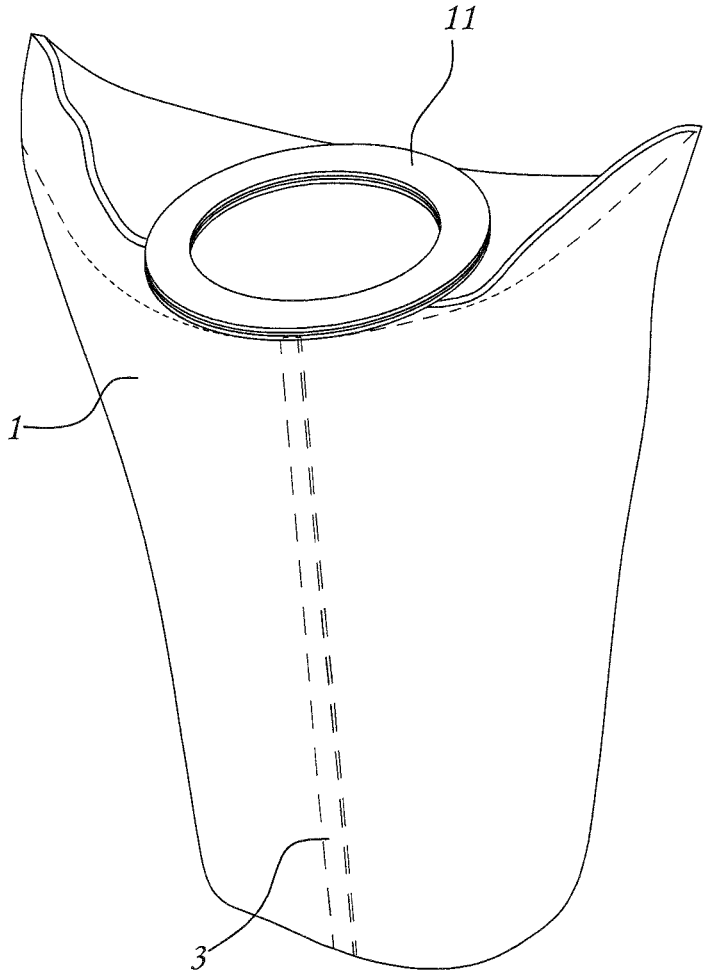
FIG. 4 is a 3-dimesional view of the storage bag, in which the two handles are overlapped to allow the bag to be used as a container.
Figure 5:
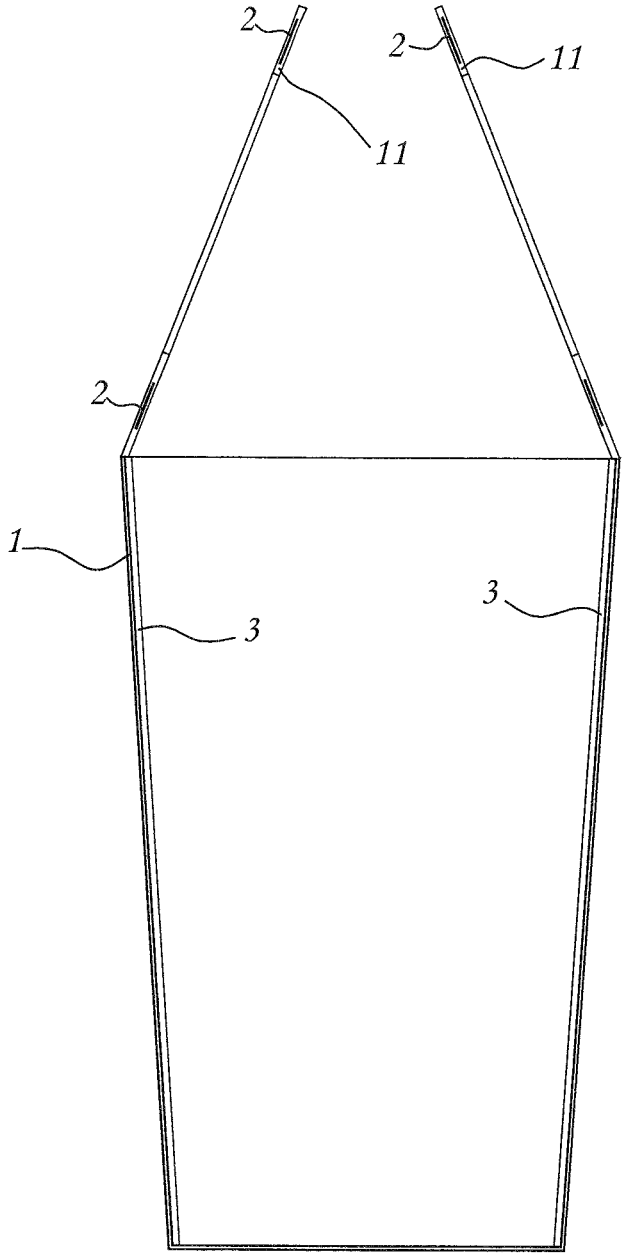
FIG. 5 is a sectional view of the storage bag, in which the two handles are separated from each other.
Figure 6:
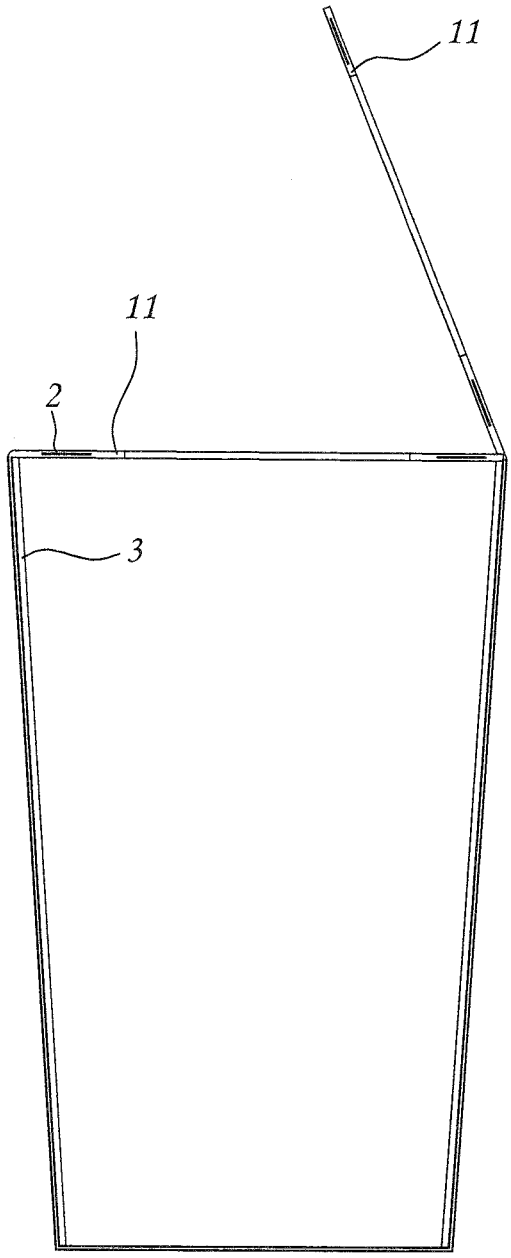
FIG. 6 is a sectional view of the storage bag, in which one of the two handles is folded horizontally to cover the opening of the bag.
Figure 7:
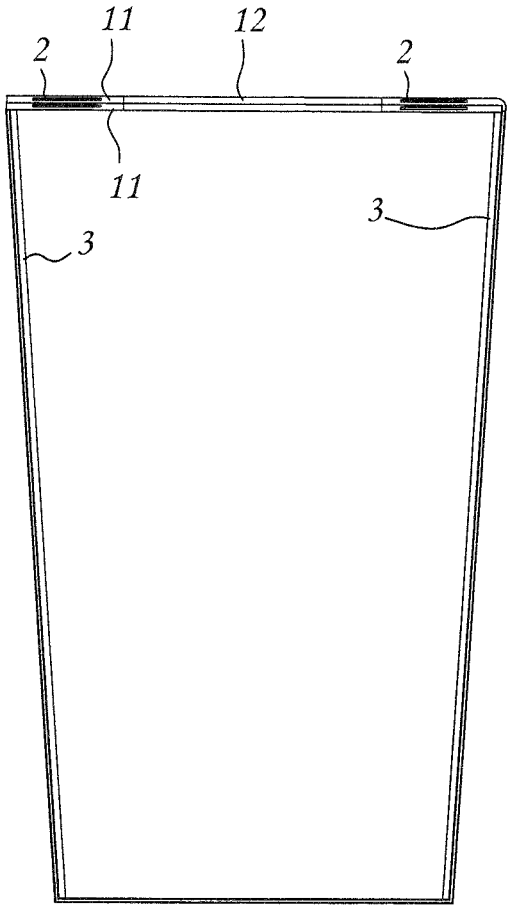
FIG. 7 is a sectional view of the storage bag, in which both of the two handles are folded horizontally to be overlapped.

Turning now to FIGS. 1 and 2, one embodiment of a storage bag according to the present invention is illustrated. The storage bag comprises a bag body 1 that defines an opening at a top thereof. The bag body 1 is provided with two handles 11 respectively at two opposing sides thereof, in which each handle 11 defines a handle hole 12 and is provided with at least one fastening member 2 that can be detachably fastened with a corresponding fastening member 2 provided on the other handle 11 so as to combine the two handles 11. The fastening members respectively provided on the handles can be magnets, Velcro fasteners (see FIG. 3), buttons, or any other members that can be coupled together. Also, the two folding lines 13 are respectively defined at the two opposing sides below the two handles 11. When the bag body 1 is extended into shape to be used as a container, the handles 11 can be folded relative to the bag body 1 respectively along the folding lines 13 to be overlapped horizontally. The bag body 1 can be made of a material that has appropriate strength and toughness. For example, the bag body 1 can be made of a cloth having appropriate thickness. Alternatively, the bag body 1 can be designed to contain an interlayer within a body material of the bag body, so that the bag body 1 can be easily extended into shape to be served as a container.

The bag body 1 is further provided with at least one support bar 3 at a middle section of each of the two opposing sides. Each support bar 3 can be affixed to an interlayer within the body material of the bag body 1 or an inner surface of the bag body 1 at each side by using manual or automatic stitching techniques. Each support bar 3 extends from a bottom of the bag body 1 to an underside of one of the handles 11 being located horizontally. Each support bar 3 has a length less than the distance from the bottom of the bag body 1 to one of the folding lines 13. When the handles 11 are folded relative to the bag body 1 to be overlapped horizontally, the support bars 3 can engage with the underside of one of the handles 11 to support the bag body 1 in the extended shape, thereby increasing the strength of bag body and preventing the extended bag body from being collapsed.

The bag body 1 can be designed in various shapes according to the preferences of users. For example, as shown in FIGS. 1-4, the bag body 1 can be designed to have a curved shape, in which two round handles 11 made of rigid material each with a round hole 12 therein are provided on the bag body for ease of carrying the bag, and two curved folding lines 13 are defined on the bag body to facilitate the handles 11 to be folded relative to the bag body 1.

In use, as shown in FIGS. 4-7, the bag body 1 can be extended into shape for preparing the bag to be served as a container. Then, one handle 11 can be folded relative to the bag body 1 along the corresponding folding line 13 to allow the handle 11 to be placed horizontally and close the opening of the extended bag body 1. Each support bar 3 can engage with the underside of the folded handle 11 so as to support the bag body 1 in the extended shape (see FIG. 6). Thereafter, the other handle 11 can be folded relative to the bag body 1 along the other folding line 13 to overlap the former handle 11, so that the fastening members 2 can be fastened with each other to combine the two handles 11 to become an integral piece with an overlapped hole 12, through which several recycling items can be put in the bag body 1 for a collection (see FIG. 7). As described above, the fastening members respectively provided on the handles can be magnets, Velcro fasteners, or buttons capable of being coupled together. When the storage bag is not in use, the two handles 11 can be returned to their original positions to allow the bag body 1 to be collapsed so that the bag body 1 will occupy less space for easy storage.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. An improved storage bag of the type having a bag body that defines an opening at a top thereof and two folding lines respectively at two opposing sides thereof, said bag body being provided with two handles respectively at the two opposing sides above said folding lines, so that when said bag body is extended into shape, said handles can be folded relative to said bag body along said folding lines to be overlapped horizontally, wherein the improvement comprises:

said bag body is provided with at least one support bar at a middle section of each of the two opposing sides below said handles, each said support bar extending from a bottom of said bag body to an underside of one of said handles, each said support bar having a length less than the distance from the bottom of said bag body to one of said folding lines, so that said support bars can engage with the underside of one of said handles so as to support said bag body in the extended shape when said handles are overlapped horizontally to close the opening of said bag body.

2. The improved storage bag of claim 1, wherein two said support bars are respectively affixed to two opposing inner surfaces of said bag body.

3. The improved storage bag of claim 1, wherein two said handles are respectively provided with fastening members that can be detachably fastened with each other.

* * * * *